United States Patent [19]

Lerner et al.

[11] 4,128,461

[45] Dec. 5, 1978

[54] ALUMINUM HARD ANODIZING PROCESS

[75] Inventors: Moisey Lerner, Brookline; James H. Morse, Holliston; Mikhael Bessendorf, Brookline, all of Mass.

[73] Assignee: Sanford Process Corporation, Natick, Mass.

[21] Appl. No.: 889,933

[22] Filed: Mar. 27, 1978

[51] Int. Cl.[2] ..... C25D 11/08

[52] U.S. Cl. ..... 204/58

[58] Field of Search ..... 204/58

[56] References Cited

U.S. PATENT DOCUMENTS

| | | | |
|---|---|---|---|
| 2,743,221 | 4/1956 | Sanford | 204/58 |
| 2,897,125 | 7/1959 | Franklin | 204/58 |
| 2,905,600 | 9/1959 | Franklin | 204/58 |
| 2,977,294 | 3/1961 | Franklin | 204/58 |
| 3,020,213 | 2/1962 | Lupfer | 202/160 |

*Primary Examiner*—R. L. Andrews

*Attorney, Agent, or Firm*—Wolf, Greenfield & Sacks

[57] ABSTRACT

An improved anodizing process produces on aluminum and on alloys of aluminum a hard oxide film of greater thickness and better abrasion resistance then can be obtained in the conventional Sanford anodizing process which uses an organic substance sold under the trademark "Sanfran" as an additive to the electrolyte. In the improved process, the DC voltage employed in the conventional process is modulated by a sinusoidal AC voltage of standard industrial frequency and the modulation factor is not permitted to exceed 100% to prevent reversal of the current through the oxide film. The DC voltage is AC modulated during the entire term of the process. In an initial period of 1 to 2 minutes, the DC voltage is raised to about 10 volts and then is raised at a rate of about one half volt per minute to a level within the range of 14 to 19 volts. Upon reaching that level, the DC voltage is held constant for a dwell period of at least five minutes. The dwell period conduces to the production of an anodized coating of good industrial quality. Without the dwell period, the anodized coating produced is of inferior quality. Following the dwell period, the DC voltage is again gradually raised to cause the anodized film to increase in thickness.

4 Claims, 7 Drawing Figures

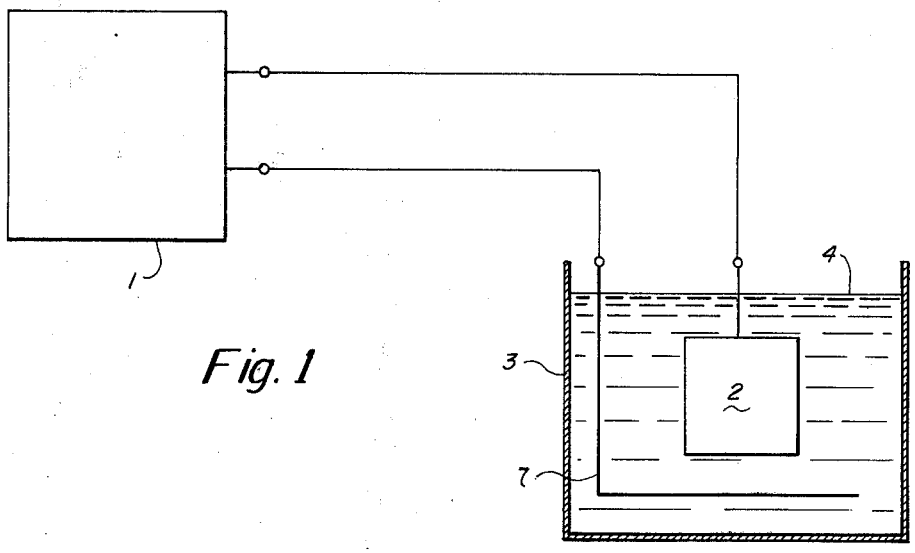
Fig. 1
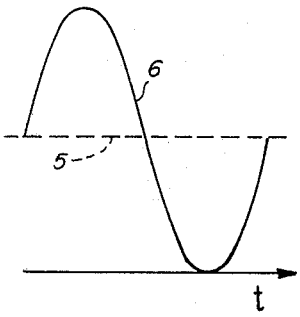
Fig. 2A
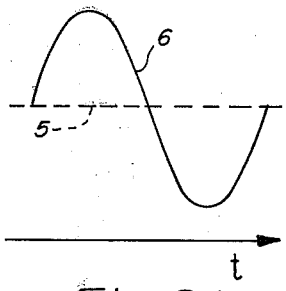
Fig. 2B
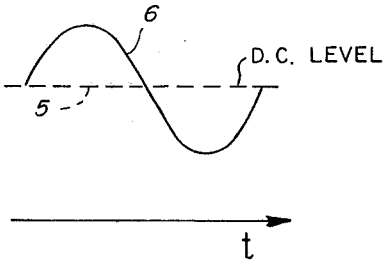
Fig. 2C
Fig. 5
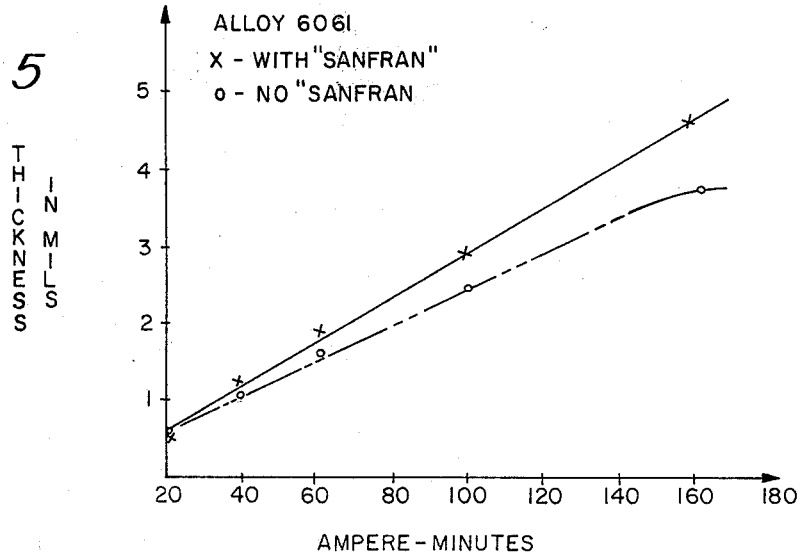

ALUMINUM HARD ANODIZING PROCESS

FIELD OF THE INVENTION

This invention relates in general to the production of hard aluminum oxide films on aluminum and on alloys of aluminum by electrolytic oxidation. More particularly the invention relates to an improved hard anodizing process that enables thicker aluminum oxide films with better abrasion resistance and with better dielectric properties to be produced than has heretofore been obtainable with commercial hard anodizing methods.

DISCUSSION OF THE PRIOR ART

Hard anodizing of aluminum and of aluminum alloys enables a porous, refractory oxide film of $Al_2O_3$ to be produced that has the hardness of sapphire and is resistant to abrasion and to chemical attack. During the anodizing process, some oxide forms at the metal-oxide interface while some of the already formed oxide is simultaneously being dissolved at the surface of the anodized film. In the hard anodizing process, the oxide which is produced has a cellular structure with fine pores into which the electrolyte penetrates and through which the electrical current passes. The protective value of the oxide film can be improved by sealing the film in various ways. Conventional sealing methods employ hot water containing chromates, or live steam, to hydrate part of the aluminum oxide and seal the pores.

During the last three decades, hard anodizing found continually widening applications in industry by endowing aluminum and its alloys with features that made them more competitive with materials like steel that have generally been deemed to be harder than aluminum and the alloys of aluminum. The wearing qualities of hard anodized aluminum and aluminum alloys can be equal to or superior to case hardened steel so that aluminum parts can be used in applications where only hardened steel was formerly employed. For brevity, the term "aluminum" as hereinafter used in this exposition includes the alloys of that metal unless the text indicates otherwise.

Hard coating of aluminum is produced by the electrochemical oxidation of aluminum in a strong electrolyte containing acids such as sulfuric acid, phosphoric acid, oxalic acid, or chromic acid. For convenience such acids may be grouped under the term "electro-oxidating acids" or may more simply be termed "hard anodizing acids". The concentration of electrolyte, the temperature of the bath, and the electric current density are adjusted to cause the rate of formation of the oxide film to be greater than the rate at which the oxide film dissolves. A high quality, hard oxide film can be produced on aluminum with an electrolyte in which (1) the concentration of sulphuric acid is usually within the range from 5.7% by volume or 100 grams per liter to 23% by volume or 400 grams per liter, (2) the temperature of the electrolyte is around 0° C. (3 ) the DC voltage at the start of anodizing is between 15 to 18 volts and is between 40 to 90 volts at the end of the process and (4) the anodizing time is about an hour. The type of alloy and the thickness of the oxide film that is to be produced determine the conditions of temperature, voltage, electrolyte concentration and time in the anodizing process.

One of the important requirements for a commercial hard anodizing process is the ability of the process to anodize any alloy of aluminum in the same electrolyte with the same temperature conditions. That requirement is termed "universality" and is especially important for the job shop where a great number of diverse parts from different customers are anodized and where the operator may not be apprized of the different alloys of aluminum used in the parts. If the hard anodizing process in the job shop does not have universality and is adjusted for a specific alloy and a part made of a different alloy is placed in the anodizing tank, that part at best may have the wrong thickness of oxide film produced on it and at worst the part may burn and be ruined. The aluminum alloys having high copper content (the 2000 series alloys) are particularly susceptable to burning and the adaptation of the hard anodizing process to that series of alloys has always been the criterion of a process having universality. The term "burning" as used in the anodizing industry means destruction by dissolution in the electrolyte. When an article is "burned", it is partly or totally dissolved.

One effective way to minimize the burning of high copper content alloys is to add to the electrolyte an acidic aqueous extract obtained by boiling a mixture of brown coal, lignite, or peat in water. The process for obtaining that extract is described in U.S. Pat. No. 2,743,221 (the Sanford patent) which was granted on Apr. 24, 1956 to Paul L. Sanford. The hard anodizing process using Sanford's acidic aqueous extract is now widely employed in the United States and in foreign countries and has become known as the "Sanford process". The distinguishing feature of that process is the addition to the electrolyte of an organic extract marketed under the trademark "Sanfran". That organic extract is essentially the acidic aqueous extract obtained by the process disclosed in the Sanford patent. The ability of the Sanford process to minimize the burning of high copper content alloys has been improved as taught by U.S. Pat. Nos. 2,897,125; 2,905,600; 2,977,294; and 3,020,219. Those first three of those improvement patents were granted to John Franklin and are assigned to Sanford Process Co., Inc. The last listed of those improvement patents was granted to John Franklin and Norton Vallance. Those four patents contributed significantly to the improvement of the Sanford process and the improvements made it possible to obtain hard coatings that were up to 2 mils thick. During the last two decades, the 2 mil thick hard coating satisfied most industrial requirements for aluminum parts having good wear resistant and chemical resistant properties.

In recent years, new demands have arisen for hard anodized coatings of more than 2 mils thickness. In some applications of hard anodized aluminum, the dielectric properties of the hard coating are as important as the coatings mechanical properties. Inasmuch as the breakdown voltage of the dielectric coating increases with the thickness of the film, coatings thicker than 2 mils are often needed. Another instance where thicker coatings are demanded is in salvage work to rescue very expensive parts that were erroneously machined undersize on critical dimensions. To salvage such parts, the undersize critical areas must often be built up with hard coatings of 10 mils or greater thickness. Anodized coatings of greater than 10 mils thickness are desired to provide thermal protection for water cooled aluminum molds employed in casting metals or alloys whose melting points are higher than the melting point of aluminum. The anodized aluminum oxide coating is a highly refractory substance and is therefore useful at the high temperatures encountered in such metal casting.

During the last decade, stricter antipollution controls have been required of industrial establishments to prevent environmental damage and contamination of resources. Waste water used to rinse parts after anodizing, for example, must, in many localities, be treated to neutralize acid contamination before the waste water can be permitted to flow into a water disposal system. The cost of the treatment can be reduced by lessening the amount of acid in the electrolyte so that the rinse water carries away less of the contaminant. From an antipollution control viewpoint therefore, an anodizing process that enables a weaker electrolyte to be used is more desirable than a process in which the electrolyte must be strongly acidic.

Another consideration for an industrial anodizing process is the amount of electrical power required in the process. An analysis of power consumption in the Sanford anodizing process presently in use indicates that approximately half that electrical power is consumed in forming the oxide film on the aluminum work. The other half of that electrical power is consumed in the refrigeration system for controlling the temperature of the electrolyte bath. Consequently, an anodizing process that can tolerate higher temperatures for the electrolytic bath while producing hard oxide coatings of equal or greater thickness than in the conventional cooled electrolyte process is desirable because of the reduction in the consumption of electrical power.

OBJECTS OF THE INVENTION

The principal objective of the invention is to improve the Sanford process for the hard anodizing of aluminum to enable thicker anodized coatings of good industrial quality to be produced.

Another object of the invention is to reduce pollution control costs by enabling the Sanford process to be performed with a weaker electrolyte without diminishing the thickness of the hard oxide film that can be produced by the process.

A further object of the invention is to reduce the power consumed in cooling the electrolytic bath by enabling the Sanford process to be carried out at higher electrolytic bath temperatures without impairing the quality or thickness of the hard anodized coating formed on the aluminum work.

DESCRIPTION OF THE DRAWINGS

FIG. 1 schematically depicts the arrangement used in the invention for producing hard anodization of aluminum;

FIG. 2 illustrates a voltage waveform of a DC voltage modulated by an AC voltage with a modulation factor of 100%;

FIG. 2B illustrates the waveform of the AC modulated DC voltage when the modulation factor is 75%;

FIG. 2C illustrates the waveform of the AC modulated DC voltage when the modulation factor is 50%;

FIG. 5 is a graph indicating the thickness of the hard oxide coating produced without Sanfran in the electrolyte and with Sanfran in the electrolyte when specimens of 6061 aluminum alloy are subject to the same ampere-minutes of current.

DETAILED DESCRIPTION OF THE INVENTION

Figure 3:
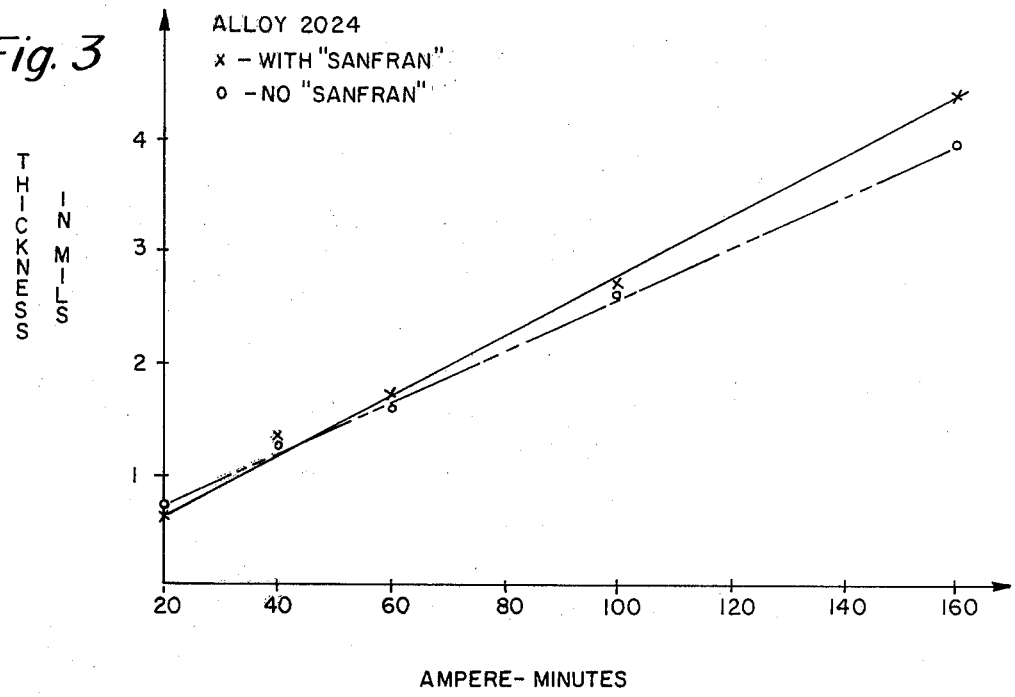
FIG. 3 is a graph indicating the thickness of the hard oxide coating produced without Sanfran in the electrolyte and with Sanfran in the electrolyte when specimens of 2024 aluminum alloy are subject to the same ampere-minutes of current.

The electrolytic oxidation of an aluminum article to produce a hard oxide coating on the aluminum is carried out in accordance with the invention by preparing the surface of the aluminum article to be coated and then immersing that article in an electrolytic bath. As schematically depicted in FIG. 1, the aluminum article 2 is immersed in an electrolytic bath 4 contained in a case 3 having in it a counter electrode 7. In actual practice the tank can be made of stainless steel and can act as the counter electrode. The electrolyte, is an aqueous solution of an electro-oxidating acid to which "Sanfran" has been added.

An AC modulated DC voltage from power supply 1 is applied between the counter electrode and the aluminum article to cause the aluminum article to be the anode of the electrolytic cell and the counter electrode to be the cathode. The AC voltage modulating the DC voltage is preferably derived from the AC voltage obtained from the electrical mains which in the United States alternates at 60Hz and is sinusoidal. The sinusoidally alternating 60Hz electrical power now available is generally referred to as being of "industrial" frequency. Considering the DC voltage to be a carrier and the AC voltage to be a modulating voltage, the modulation factor is the ratio (expressed in percent) of the amplitude of the modulating voltage to the amplitude of the carrier voltage. The modulation ratio, in accordance with our invention, preferably is not permitted to exceed 100% to prevent a reversal of the direction of current flow in the oxide film. Preferably in carrying out the process in accordance with our invention, the modulation factor, once being selected, is not changed during the performance of the process. It is, however, not essential that the modulation factor be unchanged during the entire anodizing process and changes of that modulation factor can and should be made where an improvement in the quality or thickness of the coating is obtained.

Preferably the electrolyte is an aqueous solution having about 8.14% by volume of 66 Baume sulfuric acid and about 3% by volume of "Sanfran". Depending upon the alloy of aluminum to be anodized, the temperature of the electrolyte is in the range from 25° F. to 50° F. The higher the copper content of the alloy, the higher the temperature of the electrolyte must be. Anodizing in the above specified electrolyte with a DC carrier voltage modulated by an AC sinusoidal voltage with a modulation factor of 100% produces during the first hour a hard oxide coating of about 6 mils thickness on alloy 1100, of about 5 mils thickness on alloy 2024, of about 4 mils thickness on alloy 3003, of about 8 mils thickness on alloy 5005, of about 6 mils thickness on alloy 5052, of about 3.5 mils thickness on alloy 6061 and of about 7 mils thickness of alloy 7075. In that anodizing process, the DC carrier voltage is increased linearly from 0 to 10 volts during the first minute and is then increased during the next 10 to 20 minutes to a voltage of between 15 to 19 volts. After that period, for at least the next five minutes, there is a "dwell period" in which the DC carrier voltage remains at the 15 to 19 volt level.

It has been discovered that the quality, that is the density and uniformity of the coating, is materially increased by the dwell period and enables a hard oxide coating to be produced by further anodization that is much superior to the coating obtained without the dwell period. Without the dwell period, burning of the aluminum alloy sometimes occurs when further anodization at increased voltage is attempted. After the dwell period, the carrier voltage is then increased for the remainder of the first hour up to 30, 40, or 50 volts or even higher depending upon the alloy of aluminum being anodized. Throughout the anodizing process it is preferred to keep the modulation factor at 100%.

As shown in FIG. 2A, when the DC carrier voltage whose level is indicated by the dashed line 5 is modulated by an AC sinusoid 6, the peak and valley voltages are alternately zero and double the DC level. At 100% modulation, the valley voltage momentarily reaches zero but is not allowed to drop below that level as it is undesirable to have the aluminum work become the cathode of the electrolytic cell for any appreciable time. While it is preferred to use a modulation factor of 100%, lower modulation factors can be used in the process. For example, the waveform for a 75% modulation factor is shown in FIG. 2B and the waveform for a 50% modulation factor is shown in FIG. 2C. In FIG. 2A, FIG. 2B, and FIG. 2C, the DC carrier is at the same level and the AC modulating voltage is a sinusoid. As is evident, the percentage of modulation determines the peak and valley voltages reached by the modulated waveform.

Before anodizing, the aluminum work is subjected to the following preparatory treatment in which the work is thoroughly rinsed with water after each of these steps:

a. grease is removed by washing in methyl-ethylketone (commonly referred to as MEK);
b. alkaline cleaning in composition #187NE, a product manufactured by Hubbard Hall Co;
c. deoxidation in composition #6162, a product manufactured by Diversey;
d. 30 second etch in an aqueous sodium hydroxide solution;
e. desmutting in composition #6162;
f. cleaning in a solution of 50% nitric acid.

Oxide coatings according to the invention can be produced on various types of aluminum alloys. A few examples of the anodization of such alloys are set forth in detail below. For purposes of comparison, the identical anodization process with identical alloys was performed without "Sanfran" in the electrolyte. As the examples clearly show, the process with Sanfran is clearly superior to the process without Sanfran. What the examples do not show but what is clearly evident from visual inspection is that the process with Sanfran produces a coating whose density and uniformity is much better than the coating when produced without Sanfran in the electrolyte. In each of the following examples, the specimen was a 2 × 2 × 0.04 inch flat plate of aluminum in which the type of alloy is designated in accordance with Aluminum Association Standards and Data Book, 1976–1977.

EXAMPLE 1

In this example, anodization was performed in an electrolytic bath whose temperature was maintained at between 32° to 35° F. A modulation factor of 100% was maintained through the entire length of the process. The modulating AC voltage which was superimposed on the DC carrier was a sinusoid whose frequency was 60HZ. During the first minute of anodization, the DC carrier voltage was raised from zero to 10 volts and then was increased at a constant rate of ½ volt per minute (0.5V/min.) up to 17 volts. At the 17 volt level, the DC carrier was held constant for a dwell period of 5 minutes. After the dwell period, the DC carrier voltage was again increased at the ½ volt per minute rate up to the final voltage indicated in the tabulation. During the anodization process, the electrolyte in the tank was vigorously agitated by the injection of air. In this example, anodization was carried out without Sanfran in the electrolyte. The aluminum specimen was of alloy 2024.

TABLE 1

| Ampere Minutes | Carrier Voltage | Cycle Time (minutes) | Thickness (mils) | Breakdown Voltage |
|---|---|---|---|---|
| 20 | 15.5 | 12 | .7 | 418 |
| 40 | 16.5 | 14 | 1.22 | 571 |
| 60 | 17 | 19 | 1.52 | 629 |
| 100 | 29 | 41 | 2.55 | 1092 |
| 160 | 36 | 58 | 3.83 | 1765 |

In the above table, the carrier voltage is the level of the DC carrier at the end of the corresponding cycle time inasmuch as the carrier voltage was increased at the rate of ½ volt per minute after the first minute, except for the dwell period of 5 minutes when the carrier voltage reached 17 volts.

In the above example, thickness was determined as an average of measurements at 5 locations on one side of the specimen employing a non-destructive coating thickness tester sold under the trademark "Dermitron". Breakdown voltage of the coating was determined as an average of measurements at 16 locations on one side of the specimen while employing a spherical electrode and using DC voltage in accordance with the procedure described in ASTM B110-46.

EXAMPLE 2

In this example, the aluminum specimen was a plate of alloy 2024 and the process was identical with that of example 1 except that 3.0% by volume of Sanfran was added to the electrolyte which had 8.14% by volume of 66 Baume sulfuric acid in an aqueous solution.

TABLE 2

| Ampere Minutes | Carrier Voltage | Cycle Time (minutes) | Thickness (mils) | Breakdown Voltage |
|---|---|---|---|---|
| 20 | 15 | 11 | .596 | 390 |
| 40 | 16 | 13 | 1.227 | 704 |
| 60 | 17 | 16 | 1.65 | 862 |
| 100 | 18.5 | 22 | 2.48 | 1262 |
| 160 | 28 | 41 | 4.24 | 2287 |
| 200 | 42 | 80 | 5.51 | 2620 |

In FIG. 3, the graph shows the thickness of the oxide coating obtained on the specimens of alloy 2024 with the same amount of Coulombs of current used in producing the anodized films. It is readily apparent that the presence of Sanfran in the sulfuric acid electrolyte causes an appreciably thicker oxide film to be produced. Further, the surface of the coating produced with Sanfran in the electrolyte is appreciably smoother and more homogeneous than the coating produced without Sanfran in the electrolyte.

Figure 4:
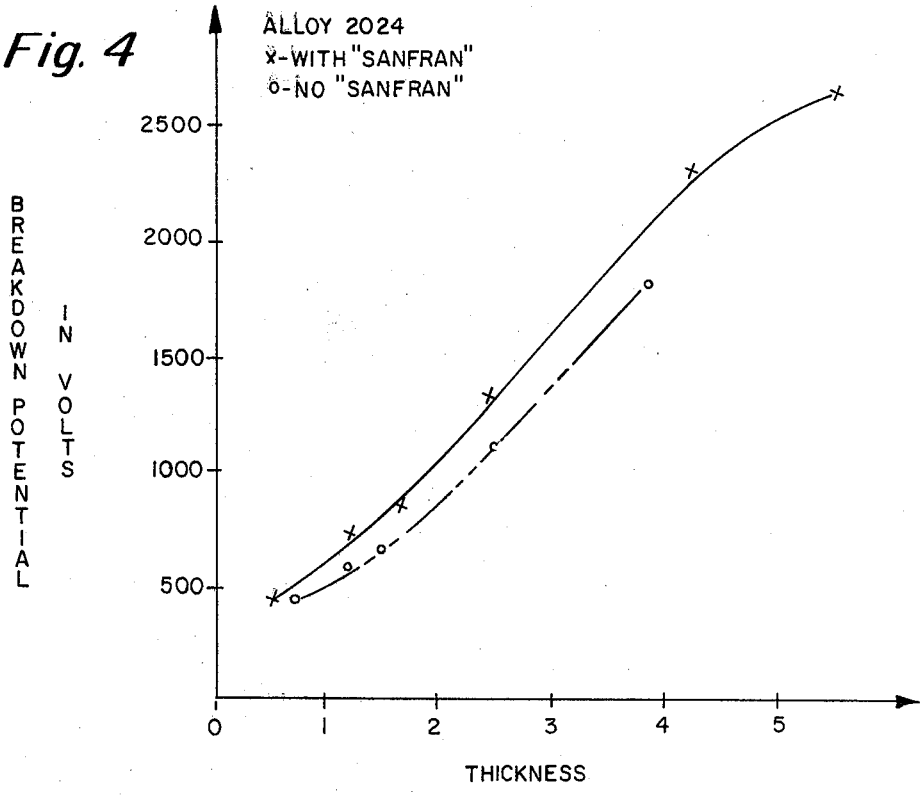
FIG. 4 is a graph showing the superior voltage breakdown properties of the hard anodizing coating produced on 2024 aluminum alloy when Sanfran is used in the electrolyte as compared with hard anodized coating produced on 2024 aluminum alloy without Sanfran in the electrolyte.

The graph of FIG. 4 shows that the breakdown voltage of the Sanfran produced oxide film is a superior insulator compared to the same thickness of oxide film that is produced without Sanfran in the electrolyte. The higher breakdown voltage of the Sanfran produced coating is consistent with the greater density and uniformity of the coating as compared with the density and uniformity of the non-Sanfran produced coating.

EXAMPLE 3

In this example, the process was identical to that used in example 1 except that the specimen was an aluminum plate of alloy 6061.

TABLE 3

| Ampere Minutes | Carrier Voltage | Cycle Time (minutes) | Thickness (mils) | Breakdown Voltage |
|---|---|---|---|---|
| 20 | 15.5 | 12 | .58 | 428 |
| 40 | 17 | 16 | 1.13 | 637 |
| 60 | 20.5 | 26 | 1.6 | 854 |
| 100 | 28 | 41 | 2.54 | 1650 |
| 160 | 42 | 85 | 3.7 | 2700 |

EXAMPLE 4

In this example, the process was identical to that used in example 2 except that the specimen of aluminum was of alloy 6061.

TABLE 4

| Ampere Minutes | Carrier Voltage | Cycle Time (minutes) | Thickness (mils) | Breakdown Voltage |
|---|---|---|---|---|
| 20 | 15 | 11 | .51 | 457 |
| 40 | 17 | 16 | 1.17 | 589 |
| 60 | 21 | 27 | 1.76 | 807 |
| 100 | 29.5 | 44 | 2.8 | 1846 |
| 160 | 42 | 87 | 4.32 | 2847 |

The graph of FIG. 5 shows the thickness of the oxide coating obtained on the specimens of alloy 6061 with the same amount of Coulombs of current used in producing the anodized films. As in the FIG. 3 graph, it is readily apparent that the addition of Sanfran to the electrolyte causes an appreciably thicker oxide film to be produced.

The improved Sanford anodizing process described above in which an A.C. modulated D.C. carrier voltage is employed needs much less sulfuric acid than the conventional Sanford anodizing process. In the preferred way of carrying out the improved process, the amount of sulfuric acid in the electrolyte can be reduced by half compared to the amount needed in the conventional Sanford anodizing process in which only D.C. voltage is used. That reduction in the concentration of sulfuric acid in the electrolyte alone is a great advantage in reducing the expense involved in neutralizing waste water. In addition, the improved process can be performed at higher electrolytic bath temperatures without causing degradation in the hardness of the oxide coat. Consequently, a reduction in the amount of energy used to cool the electrolytic bath is another advantage of the improved process apart from the principal advantage of enabling a thicker oxide coating to be produced on the aluminum work.

We claim:

1. In an anodizing process for producing a hard coating on aluminum and on alloys of aluminum wherein in the process (a) the aluminum or aluminum alloy article is immersed in an electrolyte containing an electrooxidating acid and an acidic aqueous extract obtained from the boiling of low grade coal, lignite, or peat, and (b) a DC voltage is applied between the article and a counter electrode in contact with the electrolyte whereby the article is caused to be at a positive electric potential relative to the counter electrode, the improvement comprising the steps of (1) causing the DC voltage to be sinusoidally modulated (2) raising the DC voltage level during an initial short period to about 10 volts (3) raising the DC voltage level of the modulated DC voltage at a rate of about ½ volt per minute to a level within the range of 14 to 19 volts, (4) holding the DC level of the modulated DC voltage substantially constant for a dwell period of about 5 minutes, and (5) after the dwell period, again gradually raising the DC level of the modulated DC voltage.

2. The improved anodizing process according to claim 1 wherein the DC voltage is sinusoidally modulated at a frequency in the range of 50 to 60 Hz.

3. The improved anodizing process according to claim 2, wherein the modulation factor is constant throughout steps 2, 3, 4, and 5 of the process.

4. The improved anodizing process according to claim 1 wherein the modulation factor of the modulated DC voltage does not exceed 100%.

* * * * *